US009764925B2

(12) United States Patent
Cheng

(10) Patent No.: US 9,764,925 B2
(45) Date of Patent: Sep. 19, 2017

(54) ELEVATOR SYSTEM INCLUDING A CAR STOP FOR MAINTAINING OVERHEAD CLEARANCE

(75) Inventor: Loi Cheng, South Windsor, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 560 days.

(21) Appl. No.: 14/363,395

(22) PCT Filed: Dec. 21, 2011

(86) PCT No.: PCT/US2011/066344

§ 371 (c)(1),
(2), (4) Date: Jun. 6, 2014

(87) PCT Pub. No.: WO2013/095408

PCT Pub. Date: Jun. 27, 2013

(65) Prior Publication Data

US 2014/0360818 A1 Dec. 11, 2014

(51) Int. Cl.

| | |
|---|---|
| ***B66B 11/02*** | (2006.01) |
| ***B66B 1/50*** | (2006.01) |
| ***B66B 5/00*** | (2006.01) |
| *B66B 11/08* | (2006.01) |

(52) U.S. Cl.

CPC ..... *B66B 5/0062* (2013.01); *B66B 1/50* (2013.01); *B66B 11/0246* (2013.01)

(58) Field of Classification Search

CPC . B66B 5/0056; B66B 5/0062; B66B 11/0226; B66B 11/0246; B66B 5/284; B66B 5/0087; B66B 5/288; B66B 1/50

See application file for complete search history.

(56) References Cited

U.S. PATENT DOCUMENTS 5,806,633 A * 9/1998 Macuga ..... B66B 5/005 187/279
6,223,861 B1 5/2001 Sansevero
6,446,762 B1 9/2002 St. Pierre et al.
(Continued)

FOREIGN PATENT DOCUMENTS

EP 1674416 A1 6/2006
EP 1916214 A1 4/2008
(Continued)

OTHER PUBLICATIONS

Supplementary European Search Report for Application No. EP 11 87 7738 dated Aug. 28, 2015.
(Continued)

*Primary Examiner* — William A Rivera
*Assistant Examiner* — Stefan Kruer
(74) *Attorney, Agent, or Firm* — Carlson, Gaskey & Olds

(57) ABSTRACT

An exemplary elevator system includes an elevator car. At least one guiderail is situated for guiding movement of the elevator car. A machine mount is supported by the guiderail near a top of the guiderail. A car stop is supported on the elevator car. The car stop is selectively moveable between a first position and a second position. In the first position the car stop allows the elevator car to travel to a maximum vertical position. In the second position the car stop is situated to contact the machine mount to prevent the elevator car from reaching the maximum vertical position.

18 Claims, 2 Drawing Sheets

(56) References Cited

U.S. PATENT DOCUMENTS

| | | | | |
|---|---|---|---|---|
| 6,481,534 | B1 | 11/2002 | Malone, Jr. | |
| 6,481,537 | B1 * | 11/2002 | Malone, Jr. | B66B 5/0062 187/391 |
| 6,543,584 | B1 | 4/2003 | Miyakoshi et al. | |
| 7,281,609 | B2 * | 10/2007 | Del Rio Sanz | B66B 5/0062 182/113 |
| 7,891,467 | B2 | 2/2011 | Kattainen et al. | |
| 2005/0230194 | A1 * | 10/2005 | Nakamura | B66B 5/0081 187/401 |
| 2006/0266592 | A1 | 11/2006 | Monzon et al. | |
| 2006/0289246 | A1 | 12/2006 | Aulanko et al. | |
| 2007/0034455 | A1 | 2/2007 | Coquerelle et al. | |
| 2007/0256899 | A1 | 11/2007 | Fanielle et al. | |
| 2008/0302612 | A1 * | 12/2008 | Beauchaud | B66B 5/0062 187/344 |
| 2009/0183955 | A1 | 7/2009 | Gonzalez Rodil et al. | |
| 2010/0018809 | A1 * | 1/2010 | Peacock | B66B 19/00 187/251 |
| 2010/0084224 | A1 | 4/2010 | Hao | |
| 2010/0155184 | A1 | 6/2010 | Sirigu et al. | |
| 2010/0163346 | A1 | 7/2010 | Coquerelle et al. | |
| 2010/0252369 | A1 * | 10/2010 | Tolonen | B66B 5/0056 187/379 |

FOREIGN PATENT DOCUMENTS

| | | | | |
|---|---|---|---|---|
| EP | 1 386 876 | B1 | 5/2014 | |
| ES | WO 2008002300 | A1 * | 1/2008 | B66B 5/0081 |
| FR | 2795060 | A1 * | 12/2000 | B66B 5/005 |
| JP | 7041264 | A | 2/1995 | |
| JP | 2002096979 | A | 4/2002 | |
| JP | 2007084176 | A | 4/2007 | |
| JP | 2008230724 | A | 10/2008 | |
| WO | 2005026033 | A1 | 3/2005 | |
| WO | 2005032992 | A1 | 4/2005 | |

OTHER PUBLICATIONS

International Search Report and Written Opinion of the International Searching Authority for International Application No. PCT/US2011/066344 dated Oct. 4, 2012.

International Preliminary Report on Patentability for International application No. PCT/US2011/066344 dated Jul. 3, 2014.

* cited by examiner

ELEVATOR SYSTEM INCLUDING A CAR STOP FOR MAINTAINING OVERHEAD CLEARANCE

BACKGROUND

Elevator systems typically require periodic inspection and maintenance. Historically, elevator system components, such as elevator machines and controllers, were located in machine rooms that were constructed above the elevator hoistways. Inspection and maintenance of these components could be performed by a mechanic or technician inside the machine room. With the introduction of machine roomless elevator systems, components previously located in the machine room are now located in the hoistway. While relocating these components has many advantages, it has made inspection and maintenance activities more difficult and more dangerous, because the mechanic or technician must now be within the hoistway to access the components. A variety of techniques and devices have been proposed to address the special considerations associated with performing inspection and maintenance procedures from within a hoistway.

For example, different devices have been proposed for maintaining adequate clearance between the top of the elevator car and a ceiling of the hoistway. Example devices are shown in U.S. Pat. Nos. 6,481,534 and 7,281,609 and in the United States Patent Application Publication Nos. 2009/0183955 and 2010/0155184. Other devices have also been proposed.

SUMMARY

An exemplary car stop for maintaining a minimum safe working area above an elevator car located in a hoistway includes: a plurality of leg members, each leg member having a first end configured to be pivotally attached to a top of the elevator car, and a second end; a cross member, configured to be secured to the second end of each of the leg members; and a plurality of mounting brackets configured to be secured to a machine mount located proximate a top of the hoistway and secured to a plurality of guide rails. The plurality of legs are configured to pivot between a first position in which the cross member is proximate the top of the elevator car and a second position in which the cross member is proximate the plurality of mounting brackets. A mechanical strength of the system is sufficient to prohibit upward movement of the elevator car when the plurality of legs are in the second position.

In one exemplary car stop having one or more features of the above-mentioned car stop each of the mounting brackets comprises a mounting bracket contact surface, the cross member comprises a plurality of cross member contact surfaces, and the mounting bracket contact surfaces are configured to contact a respective one of the cross member contact surfaces when the plurality of legs is in the second position.

One exemplary car stop having one or more features of the above-mentioned car stop includes a plurality of mounting members to pivotally attach respective ones of the plurality of legs to the elevator car.

An exemplary elevator system includes an elevator car, at least one guiderail situated for guiding movement of the elevator car, a machine mount at least partially supported by the guiderail near a top of the guiderail, and a car stop supported on the elevator car. The car stop is selectively moveable between a first position and a second position. In the first position the car stop allows the elevator car to travel to a maximum vertical position. In the second position the car stop is situated to contact the machine mount to prevent the elevator car from reaching the maximum vertical position.

In one exemplary elevator system having one or more features of the above-mentioned elevator system the car stop comprises a plurality of generally parallel legs and a cross member that is generally perpendicular to the legs. The cross member is connected to the legs near an end of each leg. The cross member has a contact surface for contacting the machine mount when the car stop is in the second position.

One exemplary elevator system having one or more features of the above-mentioned elevator system includes at least one pad on the contact surface of the cross member. The pad is configured to contact the machine mount when the car stop is in the second position.

In one exemplary elevator system having one or more features of the above-mentioned elevator system the at least one pad is visibly distinct from an adjacent portion of the cross member to provide a visible indication of a location where the car stop will contact the machine mount.

In one exemplary elevator system having one or more features of the above-mentioned elevator system the legs are generally vertical in the second position and generally horizontal in the first position.

In one exemplary elevator system having one or more features of the above-mentioned elevator system the at least one guide rail comprises a plurality of guide rails with at least one guide rail near each of two opposite sides of the elevator car, the machine mount comprises a base plate that is generally perpendicular to the guide rails, and the cross member is generally parallel to the base plate.

In one exemplary elevator system having one or more features of the above-mentioned elevator system the machine mount comprises a bed plate and at least one bracket for securing the machine mount to the at least one guide rail and the car stop is situated to contact the at least one bracket when the car stop is in the second position.

One exemplary elevator system having one or more features of the above-mentioned elevator system includes a controller to control movement of the elevator car and an indicator to provide an indication to the controller when the car stop is in the second position.

In one exemplary elevator system having one or more features of the above-mentioned elevator system the controller allows movement of the elevator car in an inspection mode when the indicator provides the indication.

In one exemplary elevator system having one or more features of the above-mentioned elevator system the controller prevents the elevator car from moving when the indicator provides the indication.

In one exemplary elevator system having one or more features of the above-mentioned elevator system the elevator car is within a hoistway and the car stop is situated relative to the elevator car in a position where the car stop is manually moveable between the first and second positions by an individual that is outside of the hoistway.

One exemplary elevator system having one or more features of the above-mentioned elevator system includes anti-vibration members secured to the car stop in a position where the anti-vibration members are between the elevator car and the car stop when the car stop is in the first position.

The various features and advantages of the disclosed example embodiments will become apparent to those skilled in the art from the following detailed description. The drawings that accompany the detailed description can be briefly described as follows.

DETAILED DESCRIPTION

Figure 1:
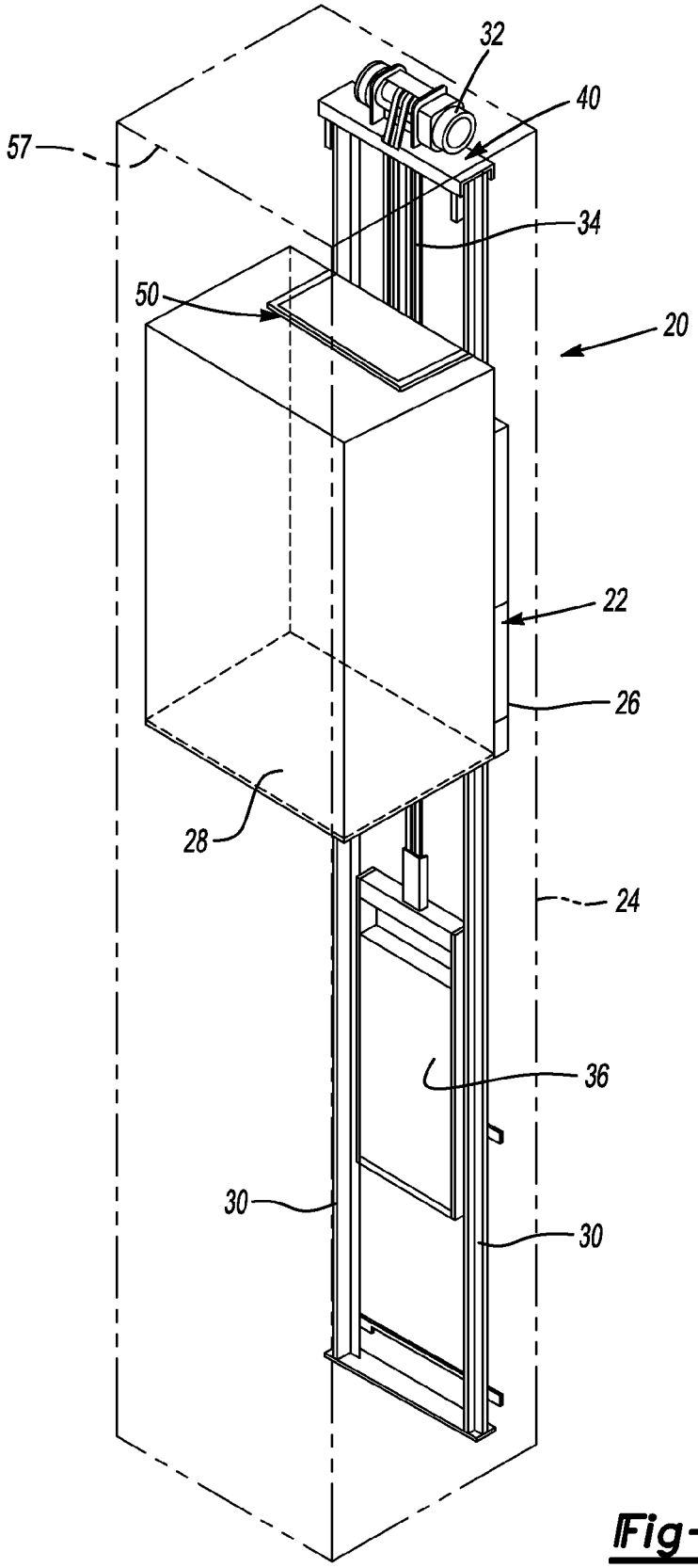
FIG. 1 schematically illustrates selected portions of an exemplary elevator system including a car stop designed according to an embodiment of this invention.

FIG. 1 schematically illustrates selected portions of an elevator system 20 according to an exemplary embodiment of the present invention. As depicted in FIG. 1, an elevator car 22, including a car frame 26 and a cab 28, is movably mounted within a hoistway 24. The car frame 26 is movable along guide rails 30 within the hoistway 24. The car frame 26 is supported in a cantilevered manner in this example.

The elevator car 22 is mounted such that it may be moved by a machine 32. The machine 32 is able to move the elevator car 22 by moving tension and support members 34, such as ropes or belts that couple the elevator car 22 to a counterweight 36. The machine 32 is supported by a machine mount 40 located near a top of the hoistway 24. As can best be appreciated from FIGS. 2 and 3, the machine mount 40 includes a bed plate 42 and mounting brackets 44. The bed plate 42 is positioned generally perpendicular to the guide rails 30, and extends between the guide rails 30. As shown in the Figures, the bed plate may extend beyond the guide rails 30. The bed plate 42 may be composed of a single plate, or it may comprise a plurality of plates. The mounting brackets 44 secure the machine mount 40 to the guide rails 30 near a top end of the guide rails 30.

Figure 2:
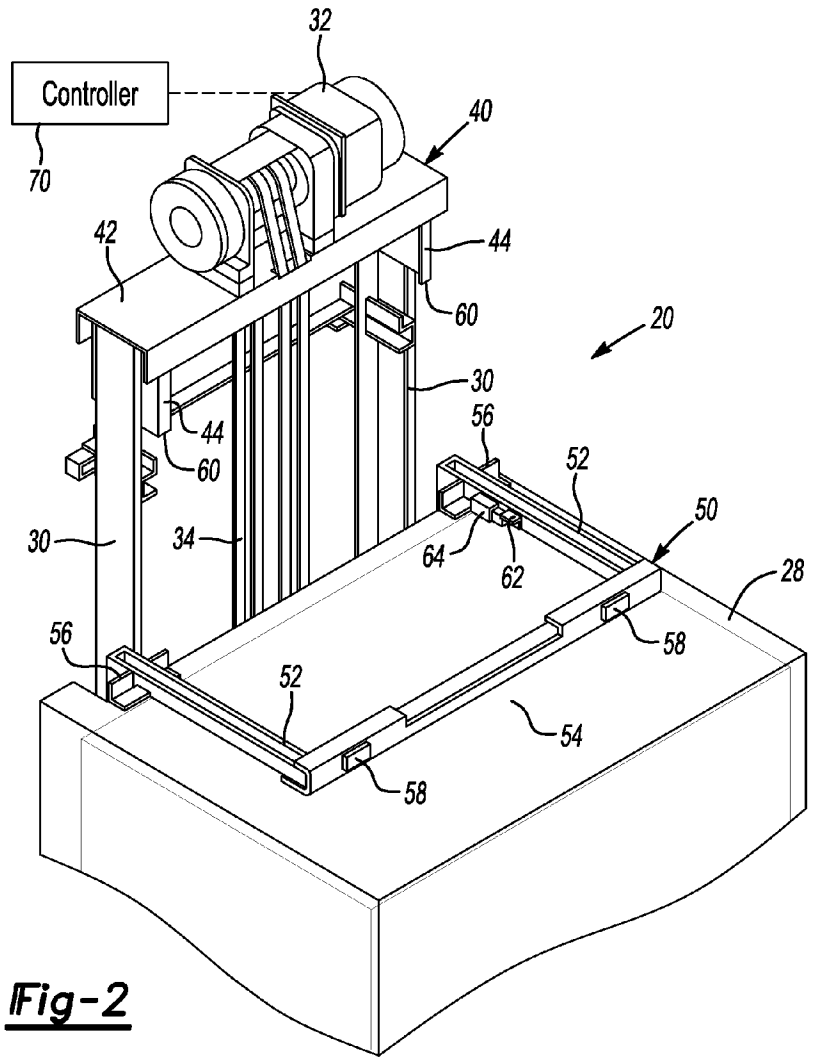
FIG. 2 illustrates selected portions of the system of FIG. 1 with the car stop in a first position.

A car stop 50 is supported on the elevator car 22. As shown in FIG. 2, the car stop 50 has a first position in which it does not restrict the elevator car 22 from moving within the hoistway 24. In the illustrated first position, the car stop 50 is positioned substantially parallel to the top of the elevator cab 28.

The example car stop 50 includes legs 52 and a cross member 54 extending between the legs 52. The legs 52 and the cross member 54 in this example each comprise a metallic piece such as a channel, beam, or tube.

Figure 3:
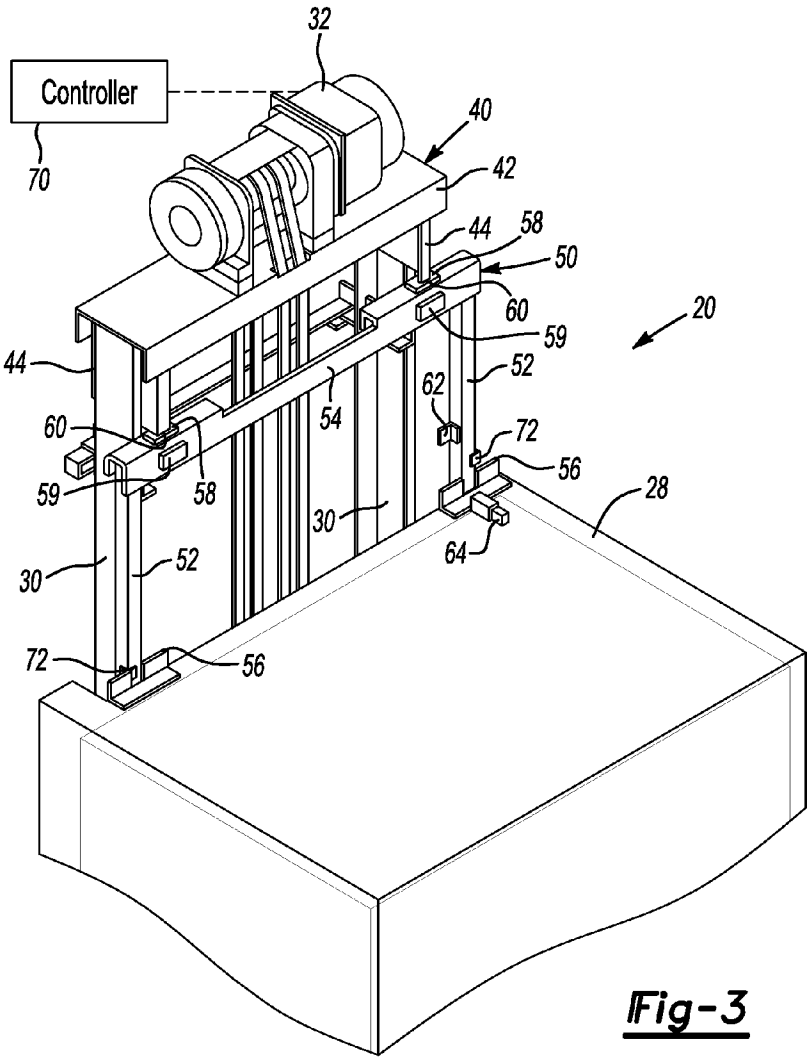
FIG. 3 shows the components illustrated in FIG. 2 with the car stop in a second position.

Mounting members 56 support the car stop 50 such that it is moveable relative to the elevator car 22 between the first position shown in FIG. 2 and a second position shown in FIG. 3. In this example, the car stop 50 is pivotally moveable relative to the elevator cab 28.

In the second position, shown in FIG. 3, the car stop is configured to contact a portion of the machine mount 40 in order to restrict the vertical movement of the elevator car 22. In this position, the car stop 50 prevents the elevator cab 28 from reaching the top of the hoistway 24. By preventing the elevator cab 28 from reaching the top of the hoistway 24, the car stop 50 ensures that there is a desired amount of clearance between the top of the elevator cab 28 and the hoistway ceiling 57 (shown in FIG. 1) above the elevator cab 28. By physically maintaining this clearance, the elevator system according to this exemplary embodiment of the invention is able to ensure the safety of any technician working on the top of the cab 28 within the hoistway 24. Even if the machine 32 attempts to raise the cab 28 to the top of the hoistway 24, the car stop 50 will physically prevent movement past a certain point. The physical bather supplied by the car stop 50 cannot be overcome by the force of the machine 32.

In the illustrated example, the cross member 54 includes a contact surface 58 for contacting a surface 60 on the machine mount 40. In this example, the contact surface 60 is on the mounting brackets 44. In another example, the contact surface 60 is on the bed plate 42. In this example, the contact surface 58 of the cross member 54 includes pads that are visibly distinct from other portions of the cross member 54. The visible aspect of the pads on the contact surface 58 provide a visible indication to an individual of the location where the car stop 50 will contact the machine mount 40 when the car stop 50 is in the second position. This feature helps individuals avoid pinch points when on top of the elevator cab 28. In further embodiments, the pads may be brightly colored or contain messages to help draw attention to them.

The illustrated example also includes anti-vibration pads 59 on at least one of the cross member 54 or the legs 52. The anti-vibration pads 59 are situated to face the top of the elevator cab 28 to reduce or minimize any vibration or noise that might otherwise occur as the elevator car 22 moves with the car stop 50 in the first position shown in FIG. 2.

As can be appreciated from FIG. 3, when the car stop 50 is in the second position, the legs 52 are in a generally vertical position, and the cross member 54 is generally horizontal. The legs 52 are structurally capable of withstanding any expected impact between the contact surfaces 58 and 60. The mounting members 56 in this example facilitate transferring the forces associated with any contact between the car stop 50 and the machine mount 40 to other portions of the car frame 26.

In the illustrated example, at least one of the legs 52 includes a position indicating feature 62 that cooperates with an indicator 64 such as an electronic switch. The indicator 64 provides an indication of the position of the car stop 50. The indicator 64 provides an indication to a controller 70 that is responsible for controlling operation of the machine 32. In one example, the controller 70 prevents the machine 32 from moving the elevator car 22 whenever the indicator 64 provides an indication that the car stop 50 is in the second position shown in FIG. 3. In a further example the controller 70 prevents the machine 32 from moving the elevator car 22 whenever the indicator 64 fails to provide an indication that the car is in the first position as shown in FIG. 2. In another example, the controller 70 allows the machine 32 to operate in an inspection mode responsive to an indication from the indicator 64 that the car stop 50 is in the second position.

At least one latch or locking member 72 facilitates holding the car stop 50 in the second position. In this example, a latch or locking member 72 is associated with each of the mounting members 56.

The car stop 50 has a vertical height when it is in the second position shown in FIG. 3. That vertical height establishes a portion of the desired clearance above the top of the elevator cab 28. The desired clearance distance is equal to the sum of the distance between the ceiling 57 above the elevator cab 28 and the contact surface 60 on the machine mount 40 and the vertical height of the car stop 50.

One feature of the illustrated example is that it does not require reinforcing a ceiling structure above an elevator car, as was required in previous device which relied on the physical strength of the hoistway ceiling to prevent further upward movement of elevator cars. Instead, an exemplary embodiment of the disclosed system relies on the physical contact between the top of the cab 28, the car stop 50, the contact surface 60, the mounting brackets 44, and the machine mount 40 to prevent further upward movement of the elevator car 22, thereby ensuring a desired clearance above the elevator car. Utilizing the contact between the car stop 50 and the machine mount 40 allows for a more cost effective and less error prone construction and design of the hoistway structure; including the hoistway ceiling. While the above disclosed exemplary embodiment relies on the iterated physical components, a person skilled in the art, having the benefit of this disclosure, would understand that it is possible to modify or even remove some of the physical components while remaining within the scope and spirit of the invention.

Another feature of the exemplary embodiment is that the car stop 50 is situated on top of the elevator cab 28 in a position where it is accessible by individuals outside of the hoistway 24. For example, a mechanic may position the elevator car 22 within the hoistway 24 such that the top of the elevator cab 28 is accessible through a hoistway opening at an uppermost landing along the hoistway 24. The mechanic can reach into the hoistway and manually manipulate the car stop 50 from the first position (shown in FIG. 2) to the second position (shown in FIG. 3) before the mechanic enters the hoistway. This ensures that the desired clearance above the elevator cab 28 will be available to the mechanic before the mechanic has to enter the hoistway and prevents situations where the elevator car is allowed to move beyond the desired upward limit after an individual enters the hoistway but before the individual can operate the safety device.

The preceding description is exemplary rather than limiting in nature. Variations and modifications to the disclosed example may become apparent to those skilled in the art that do not necessarily depart from the essence of this invention.

I claim:

1. A car stop for maintaining a minimum safe working area above an elevator car located in a hoistway, the car stop comprising:

a plurality of leg members, each leg member having a first end configured to be pivotally attached to a top of the elevator car, and a second end;

a cross member, configured to be secured to the second end of each of the leg members; and a plurality of mounting brackets, configured to be secured to a machine mount located proximate a top of the hoistway and secured to a plurality of guide rails, wherein the plurality of legs are configured to pivot between a first position in which the cross member is proximate the top of the elevator car and a second position in which the cross member is proximate the plurality of mounting brackets when the elevator car is proximate a top of the hoistway, and wherein the car stop physically prohibits upward movement of the elevator car when the plurality of legs are in the second position and the cross member is proximate the plurality of mounting brackets.

2. The car stop of claim 1, wherein each of the mounting brackets comprises a mounting bracket contact surface, and the cross member comprises a plurality of cross member contact surfaces, and wherein the mounting bracket contact surfaces are each configured to contact a respective one of the cross member contact surfaces when the plurality of legs is in the second position.

3. The car stop of claim 1, further comprising a plurality of mounting members to pivotally attach respective ones of the plurality of legs to the elevator car.

4. An elevator system, comprising:

an elevator car;

at least one guide rail to guide movement of the elevator car;

a machine mount mounted on the at least one guide rail near a top of the at least one guide rail; and a car stop supported on the elevator car, the car stop being selectively moveable between a first position, in which the car stop allows the elevator car to travel to a predetermined vertical position, and a second position, in which the car stop is situated to contact the machine mount to prevent the elevator car from reaching the predetermined vertical position.

5. The elevator system of claim 4, comprising at least one pad on the cross member, the pad being configured to contact the machine mount when the car stop is in the second position.

6. The elevator system of claim 5, wherein the at least one pad is visibly distinct from an adjacent portion of the cross member to provide, to an individual on the elevator car, a visible indication of a location where the car stop will contact the machine mount.

7. The elevator system of claim 4, wherein the car stop comprises a plurality of legs and a cross member that is oriented transverse to the legs, the cross member being connected to the legs near an end of each leg, the cross member having a contact surface for contacting the machine mount when the car stop is in the second position.

8. The elevator system of claim 7, wherein at least a portion of each of the legs is vertical in the second position and horizontal in the first position.

9. The elevator system of claim 8, wherein the legs are entirely vertical in the second position and entirely horizontal in the first position.

10. The elevator system of claim 7, wherein the at least one guide rail comprises a plurality of guide rails with at least one guide rail near each of two opposite sides of the elevator car;

the machine mount comprises a base plate including at least a portion that is perpendicular to the guide rails; and the cross member includes at least a portion that is parallel to the base plate at least when the car stop is in the second position.

11. The elevator system of claim 10, wherein the base plate is entirely perpendicular to the guiderails and the cross member is entirely parallel to the base plate at least when the car stop is in the second position.

12. The elevator system of claim 7, wherein the legs are parallel to each other and the cross member is perpendicular to the legs.

13. The elevator system of claim 4, comprising a controller to control movement of the elevator car; and an indicator to provide an indication to the controller when the car stop is in the second position.

14. The elevator system of claim 13, wherein the controller allows movement of the elevator car in an inspection mode when the indicator provides the indication.

15. The elevator system of claim 13, wherein the controller prevents the elevator car from moving when the indicator provides the indication.

16. The elevator system of claim 4, wherein the machine mount comprises a bed plate and at least one bracket for securing the machine mount to the at least one guide rail; and the car stop is situated to contact the at least one bracket when the car stop is in the second position.

17. The elevator system of claim 4, wherein the elevator car is within a hoistway and the car stop is situated relative to the elevator car in a position where the car stop is manually moveable between the first and second positions by an individual that is outside of the hoistway.

18. The elevator system of claim 4, comprising anti-vibration members secured to the car stop in a position where the anti-vibration members are between the elevator car and the car stop when the car stop is in the first position.

* * * * *